US008267580B2

(12) United States Patent
Schneider

(10) Patent No.: US 8,267,580 B2
(45) Date of Patent: Sep. 18, 2012

(54) FREESTANDING BAG

(75) Inventor: Jakob Schneider, Niederkassel (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 942 days.

(21) Appl. No.: 11/598,103

(22) Filed: Nov. 13, 2006

(65) Prior Publication Data

US 2007/0071370 A1 Mar. 29, 2007

Related U.S. Application Data

(63) Continuation of application No. PCT/EP2005/004347, filed on Apr. 22, 2005.

(30) Foreign Application Priority Data

May 13, 2004 (DE) ..... 10 2004 024 005

(51) Int. Cl.

| | |
|---|---|
| ***B65D 30/16*** | (2006.01) |
| ***B65D 33/08*** | (2006.01) |
| ***B65D 33/06*** | (2006.01) |
| ***B65D 33/02*** | (2006.01) |
| ***B65D 30/20*** | (2006.01) |
| ***B65D 30/10*** | (2006.01) |

(52) U.S. Cl. ..... 383/104; 383/10; 383/17; 383/20; 383/119; 383/120; 383/121

(52) U.S. Cl. .....

(58) Field of Classification Search ..... 383/119, 383/17, 104, 20, 120, 121, 10

See application file for complete search history.

(56) References Cited

U.S. PATENT DOCUMENTS

| | | | | |
|---|---|---|---|---|
| 1,672,322 | A * | 6/1928 | Keiser et al. | 383/119 |
| 1,846,542 | A * | 2/1932 | Budd | 383/15 |
| 3,442,437 | A * | 5/1969 | Mann | 383/10 |
| 3,596,824 | A * | 8/1971 | Lehmacher et al. | 383/10 |
| 3,682,372 | A * | 8/1972 | Rodley | 383/104 |
| 3,690,221 | A * | 9/1972 | Schmedding et al. | 493/218 |

(Continued)

FOREIGN PATENT DOCUMENTS

| | | |
|---|---|---|
| DE | 88 12 261 | 1/1989 |
| DE | 101 38 612 A1 | 11/2002 |
| GB | 2038777 A * | 7/1980 |

(Continued)

OTHER PUBLICATIONS

Translation of DE 88 12 261 by FLS, Inc. in May 2010.* Translation of WO 9209219 A1 by FLS, Inc. in Nov. 2006.*

*Primary Examiner* — Jes F Pascua

(74) *Attorney, Agent, or Firm* — Muncy, Geissler, Olds & Lowe, PLLC

(57) ABSTRACT

A free-standing bag and a method for producing a free-standing bag from a thermoplastic synthetic film is disclosed. The bag includes a front panel and a back panel, which are connected to one another by lateral seams thus forming a filling opening, and in a collapsed state of the bag, having an inwardly folded base, whereby the inwardly folded base is comprised of a front panel fold as well as a back panel fold, both folds being sealed into the lateral seams, and whereby in the area of the inwardly folded base, an assembly strip is attached, which is made of a reinforced plastic film, and that the assembly strip terminates at a distance from the lateral seams, whereby a reinforcing strip is attached or glued to the inside and/or outside of the front panel and the back panel in the area of the filling opening.

17 Claims, 5 Drawing Sheets

U.S. PATENT DOCUMENTS

| | | | | | |
|---|---|---|---|---|---|
| 5,158,371 | A | * | 10/1992 | Moravek | 383/104 |
| 5,580,173 | A | * | 12/1996 | Sebastian | 383/76 |
| 6,065,873 | A | | 5/2000 | Fowler | |
| 2003/0179956 | A1 | | 9/2003 | Penner et al. | |

FOREIGN PATENT DOCUMENTS

| | | | | |
|---|---|---|---|---|
| JP | 03029753 | A | * | 2/1991 |
| WO | WO 9209219 | A1 | * | 6/1992 |

* cited by examiner

FREESTANDING BAG

This nonprovisional application is a continuation of International Application PCT/EP2005/004347, which was filed on Apr. 22, 2005, and which claims priority to German Patent Application No. DE 10 2004 024 005, which was filed in Germany on May 13, 2004, and which are all herein incorporated by reference.

BACKGROUND OF THE INVENTION

1. Field of the Invention

The present invention relates to a free-standing bag made of a thermoplastic plastic film, comprised of a front panel and a back panel, which are connected to one another by lateral seams, thus forming a filling opening, and in a collapsed state of the bag having an inwardly folded base, whereby the inwardly folded base includes a front panel fold as well as a back panel fold, and whereby both folds are welded into the lateral seams, and that in the area of the inwardly folded base, an assembly strip is attached, which is made of a plastic film that is more rigid than the plastic film of the bag, and that the assembly strip terminates at a distance from the lateral seams.

2. Description of the Background Art

Free-standing bags, also referred to as block bottom bags, are commonly known. A free-standing bag of this class is described in German design patent DE 88 12 261. The therein described free-standing bag has a front panel and a back panel, which are welded together along their longitudinal sides by lateral welding seams. In addition, this bag includes a prefolded base, which is reinforced by a glued-on assembly strip. The assembly strip at the base of the bag provides the bag with the sufficient rigidness to be able to stand up, and to keep the unfolded base in an unfolded position. The assembly strip can thereby be glued to the inside or the outside. For easier handling of the bags, the bag can also be provided with carrying handles. However, although the base of such bags is reinforced, the front and back panels of such bags are made of thin-walled plastic film, and problems may arise when filling the bag depending on the product to be packaged.

SUMMARY OF THE INVENTION

It is therefore an object of the present invention to provide a free-standing bag, which is easy to fill and simple to open, and which has increased stability. Furthermore, the production of the free-standing bag to be provided should be easy and economical. It is also an object of the invention to provide a method for producing such a free-standing bag.

A reinforcing strip is attached or glued to the front and back panels in the area of the filling opening on the interior and/or exterior side. Utilizing a reinforcing strip in the area of the filling opening according to the present invention makes it possible to reinforce a free-standing bag in such a way that it is easy to open and remains inherently stable when open. Furthermore, the free-standing bag according to the present invention is very easy to produce and can be manufactured with only minimal additional expenditure because the addition of a fortification strip in form of a reinforcing strip is easy to realize with existing production equipment, that is, is easy to integrate in a production line. Adding a reinforcing strip in the area of the filling opening of the free-standing bag makes not only the filling and opening easier but also the handling of the filled bag. If the area of the filling opening is provided with a grip hole, as is suggested in one embodiment of the invention, the reinforcement strip also serves as grip-hole reinforcement.

In a further embodiment of the invention, the distance of the reinforcement strip from each lateral seam is substantially equal to the height of the base fold in a collapsed state. If the height of the basefold depth is precisely maintained as a distance to the respective edge, that is, to the lateral seam of the bag, the bag will be easy to open and the opened bag will nearly have the shape that the base area of the assembly strip outlines at the bottom of the bag. A bag such as this is easy to fill, and as a result of the reinforcement strip, is inherently stable in the filling opening.

From a method-technical aspect, the objective is met by carrying out at least the following method steps: conveying one or a plurality of flat plastic film webs, that is, webs spread out at a plane level; adding and attaching by adhesion at least one assembly strip and at least one reinforcing strip each for the back panel and the front panel; folding and joining the webs of plastic film to form at least one front panel and at least one back panel; inserting a base fold; and forming the lateral seams by welding the plastic film web.

As an alternative, it is also possible to produce a free-standing bag having a base seam and a reinforcing strip that is attached in the area of the filling opening. For this purpose, the fortification strips, which in this context refers to the assembly and reinforcing strips, are attached at the base and in the filling opening on both film layers prior to the joining of the front and back panels of the bag. Using a longitudinal welding method, the forming of the tube is then accomplished, this being the first welding step for forming the free-standing bag. Due to the method-technical sequence of the individual production steps, it is now possible to produce a free-standing bag with minimal expenditure. Adding the reinforcing strip and the assembly strip to the flatly spread-out plastic film web has the advantage that the strips can be easily attached, preferably glued on. Furthermore, the original production sequence is only slightly altered so that the method can be easily integrated in existing production lines.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
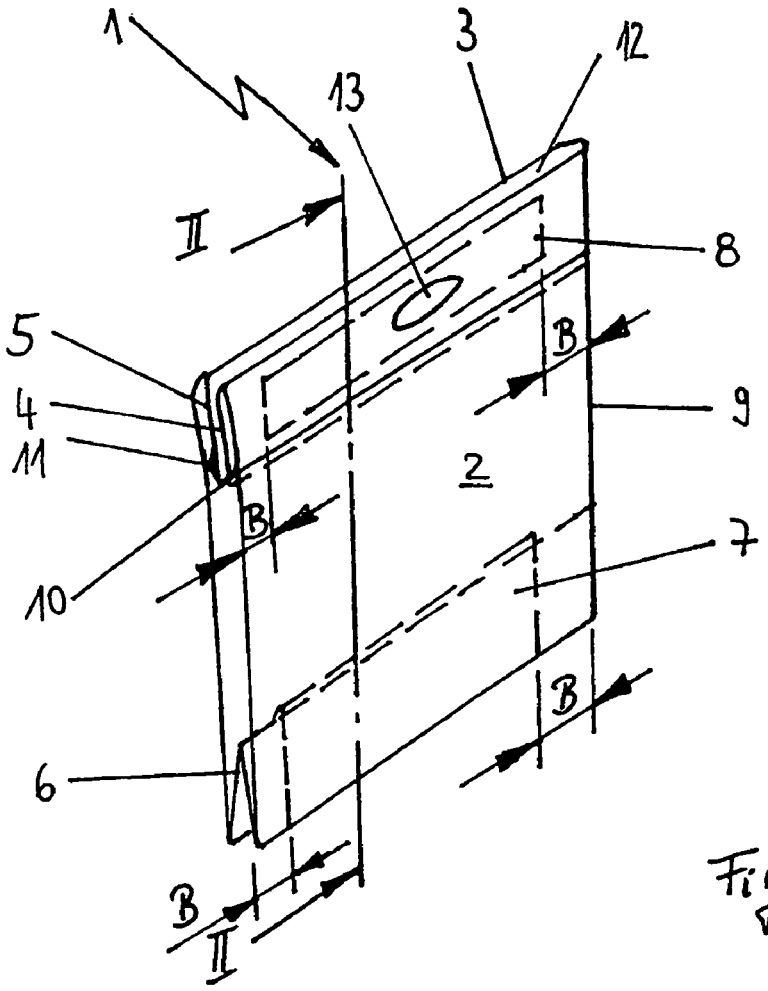
FIG. 1 is a three-dimensional view of a free-standing bag according to an embodiment of the invention, in a collapsed state.

FIG. 1 shows a free-standing bag 1 comprised of a front panel 2, a back panel 3, a double-layered area 4 of the front panel 2, and a double-layered area 5 of the back panel 3, a base fold 6, whereby an assembly strip 7 is attached to the base fold 6, and a reinforcing strip 8, which in this basic drawing, is merely sketched in the double-layered area 4 of the front panel 2. The front panel 2 and the back panel 3 are connected by two lateral seams 9. In FIG. 1, only the lateral welding seam 9 is shown, whereas the lateral welding seam on the left side in FIG. 1 was removed to clarify the construction of the free-standing bag 1. Thus, the double-layered areas 4, 5, of the front panel 2 and the back panel 3 as well as the base fold 6 can be clearly seen. The double-layered area 4, 5, is formed by diagonal welding seams 10, 11, which extend transversely to bag 1. The base fold 6 is preferably added prior to the welding of the lateral seams 9 so that the base fold 6 is connected to the lateral welding seam 9.

In an embodiment, a grip hole 13 is provided in the double-layered area 4, 5, which is also the filling opening 12. With grip hole 13, which extends through the front panel 2, the reinforcing strip 8, the double-layered area 4, the double-layered area 5 of the back panel, the reinforcing strip of the back panel, and the back panel 3, the free-standing bag can be easily picked up and transported. It goes without saying that the illustrated embodiment of the grip hole 13 is not mandatory; naturally, all known designs of grip holes 13 can be utilized in the free-standing bag 1 of the present invention.

Figure 2:
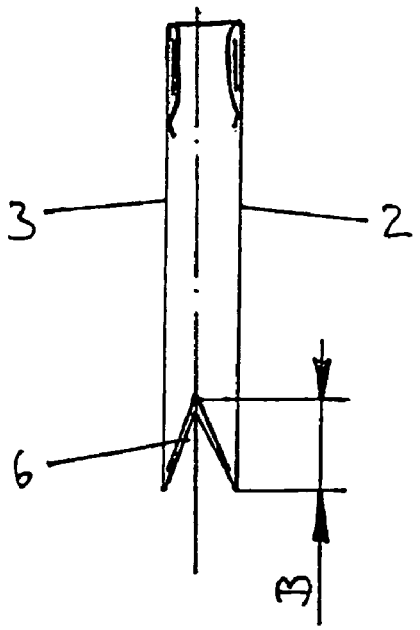
FIG. 2 is a cross section of the free-standing bag in FIG. 1.

With FIG. 2, which is a cross section of the free-standing bag 1 of the present invention according to FIG. 1, the concept of depth B of the base fold is demonstrated in more detail. Depth B of the base fold is derived from the height of the inwardly-folded base 6 of the bag in a collapsed state. If the free-standing bag 1 of the instant invention is provided with an assembly strip 7, whereby the distance to each side of the lateral welding seam 9 equals the height of the base fold depth, a free-standing bag as in FIG. 3 results therefrom. The areas of the front panel 2 and the back panel 3, which extend laterally beyond the area of the assembly strip 8 and the reinforcing strip 7, form the lateral surfaces 14, 15, of the free-standing bag in an unfolded state. One purpose of the strips 7, 8, is thereby to serve as reinforcing strips 7, 8, to stabilize bag 1, while at the same time, back panel 3 and front panel 2 can be folded and/or crimped over the ends 16 of reinforcing strip 8 and the ends 17 of assembly strip 7 in the direction of the side panels 14, 15. In this way, a box-shaped free-standing bag is formed. If the length of the assembly 7 and the reinforcing strip 8, which terminate precisely at a distance B from the side seams 9, is identical, a square free-standing bag 1 is formed corresponding to the base area of assembly strip 7.

Figure 3:
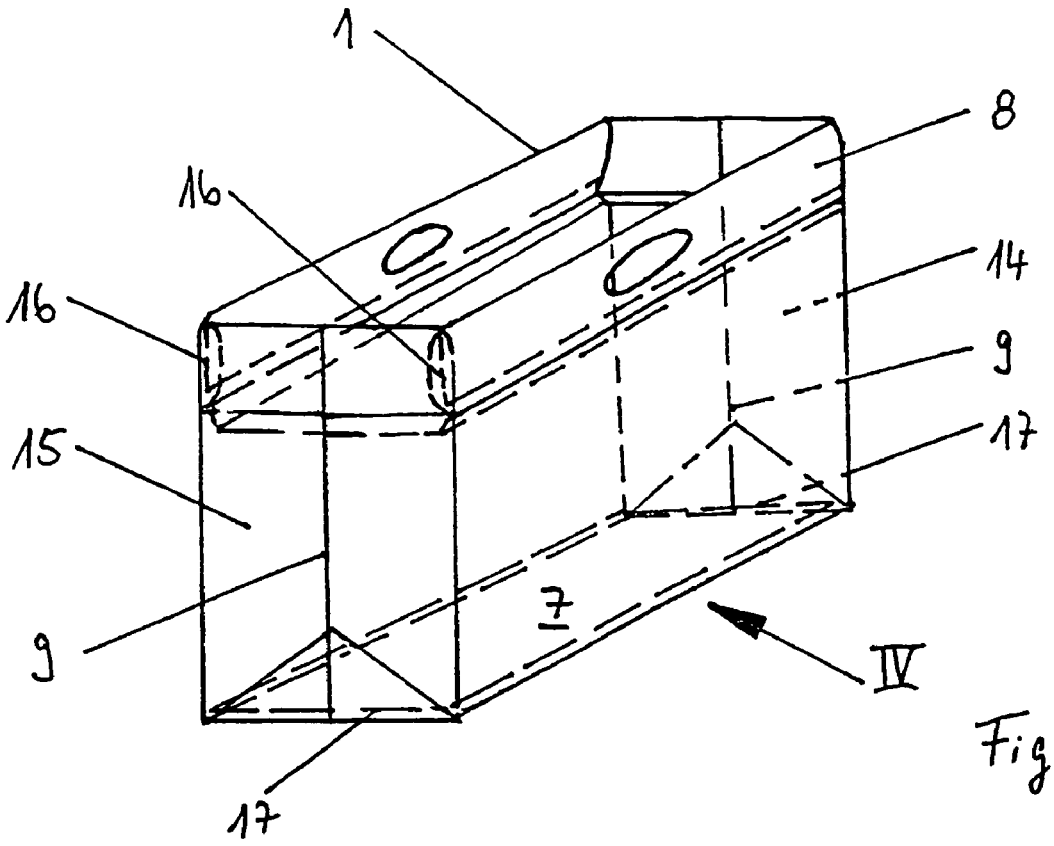
FIG. 3 is an unfolded free-standing bag in a three-dimensional view.
Figure 4:
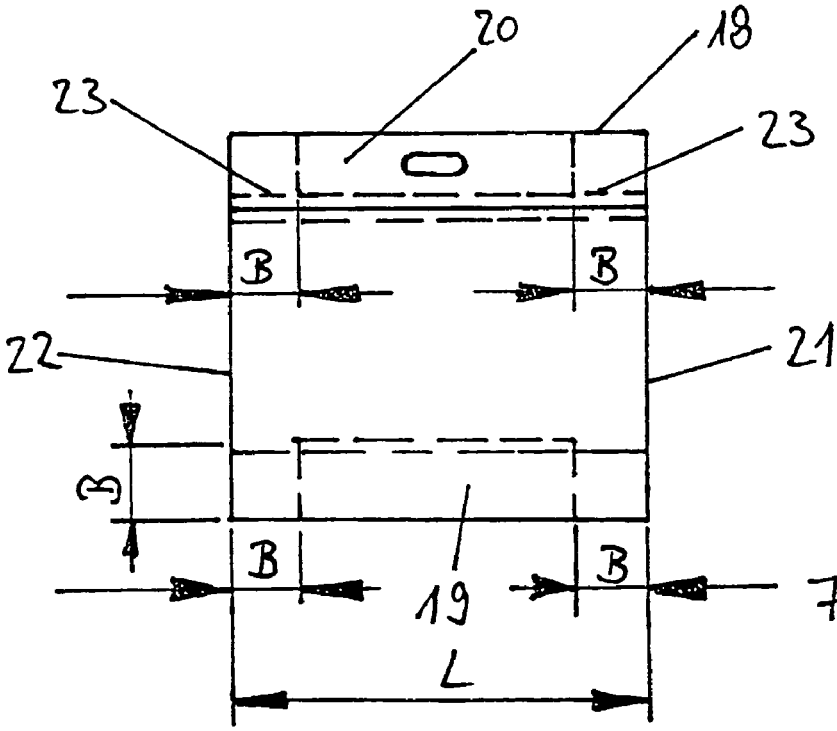
FIG. 4 is a front view of a free-standing bag in accordance with FIG. 3.

In FIG. 4, the front view of a free-standing bag 18 according to arrow IV in FIG. 3 is illustrated. Both the assembly strip 19 and the reinforcing strip 20 are hereby at a distance B, from the lateral welding seams 21, 22, of the free-standing 18, namely at a distance that corresponds with the height of the base fold depth B.

It is noted that it is not mandatory for the assembly strip 19 and the reinforcing strip 20 to be of equal length. For example, the reinforcing strip 20 can extend across the entire width L of the free-standing bag 18, as is indicated with dashed line 23. In this case, the unfolded free-standing bag would not have a square shape; rather, the filling area 12 would be pulled outwards from the center like from the hull of a ship. The shape is achieved as a result of the reinforcing strip 20 having a greater stability than the plastic film of the front panel 2 and the back panel 3, which form the free-standing bag 18. The reinforcing strips 20 create a rigidity, which is stabilized by the lateral welding seams 21, 22, at their ends. If these two reinforcing strips 20 are pulled apart in the center of bag 18, the shape described as shiphull-like results.

The free-standing bag 18 according to FIG. 4 is likewise provided with a double-layered filling opening. According to the invention, the filling area and/or the filling opening of bag 18 can also be provided on a single-layered front panel and back panel. The reinforcing strip 20 can thereby be attached to the front panel as well as the back panel from the inside or the outside. To attach the reinforcing strip 20, it is preferred to use an adhesive method. The assembly strip 19 can thereby also be glued to the inside or the outside of the base of the free-standing bag 18.

Figure 5:
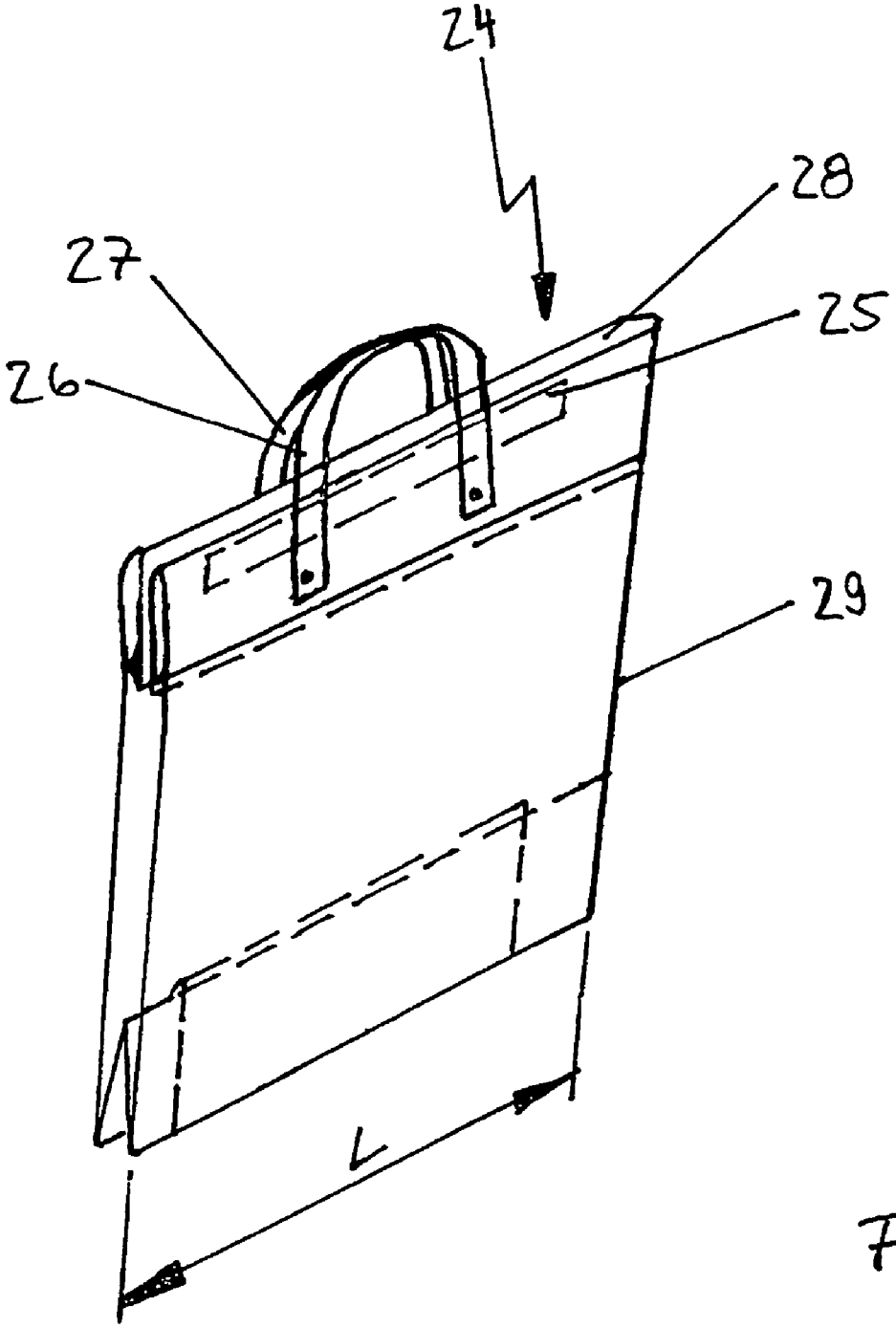
FIG. 5 is a three-dimensional view of an embodiment of the bag of the present invention in the form of a carrying bag.

The free-standing bag 24 can also be designed as a carrying bag 24, as is illustrated in FIG. 5. In FIG. 5, an isomorphic view of a carrying bag 24 provided with a reinforcing strip 25 according to the invention is illustrated. The carrying bag 24 is provided with handles 26, 27. In this embodiment, the filling opening 28 is double-layered. In this embodiment, the reinforcing strip 25 extends only across part of the width (L) of the bag; however, it can also be attached across the entire width L of carrying bag 24, and is then welded to the lateral welding seams 29. The handles 26, 27, are welded into the double-layered area of the filling opening 28 but below the reinforcing strip 25. This provides the benefit that during production of the carrying bag 24, the welding time does not negatively affect the cycle times. The carrying bag 24 can be produced at the same speed because the handle 26, 27 only needs to be welded to the double-layered area, and the more robust material of the reinforcement strip 25 does not have to be melted. Care must be taken hereby that the plastic film for producing the front panel and the back panel of the free-standing bag 24 is a plastic film that preferably is 50 μm thick, and that the reinforcing strip 25 has a thickness of circa 100-200 μm. Welding of the handles 26, 27, in the area of the reinforcing strip 25 would thus have a negative effect on the cycle time.

Figure 6:
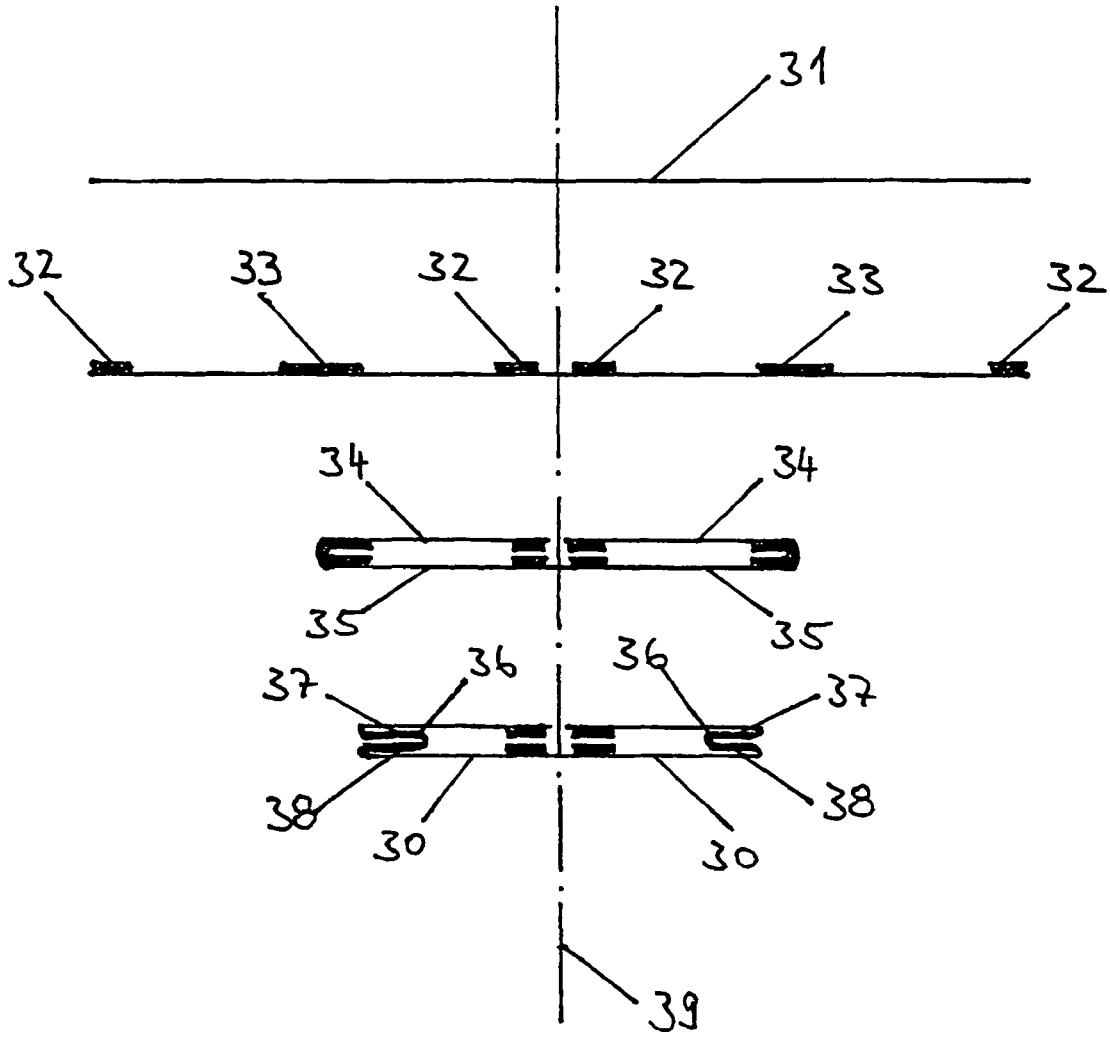
FIG. 6 is a basic illustration of a method for producing a free-standing bag of the present invention.

In FIG. 6, a possible basic progression of a production line for producing a free-standing bag 30 having a single-layered filling area is shown. The reinforcement strips 32 as well as the assembly strips 33 are glued to the horizontally spread-out, that is, plane, web of plastic film 31, which is fed into the production machine. Because strips 32, 33, are added in the direction of the web, any desired adjustment of the length of strips 32, 33, with regard to length L of a free-standing bag 30 is possible. For example, the reinforcing strips 32 can extend across the entire length L of free-standing bag 30, or be restricted to a short griphole area 13. After introducing strips 32, 33, and attaching them with adhesive, the web of plastic film 31 is folded to form front panel 34 and back panel 35 of the free-standing bag 30 to be produced. Subsequently, the base fold 36 is formed into the free-standing bag 30 to be produced. After the base fold 36 has been added, the web of plastic film 31 is welded to form the lateral seams of the free-standing bag 30. As a result of the welding, or after the welding, the web of plastic film 31 is severed so that separate free-standing bags 30 are formed. In this case, the severance of the plastic film 31 would take place wherever the two bags 30 are divided by symmetry line 39.

Figure 7:
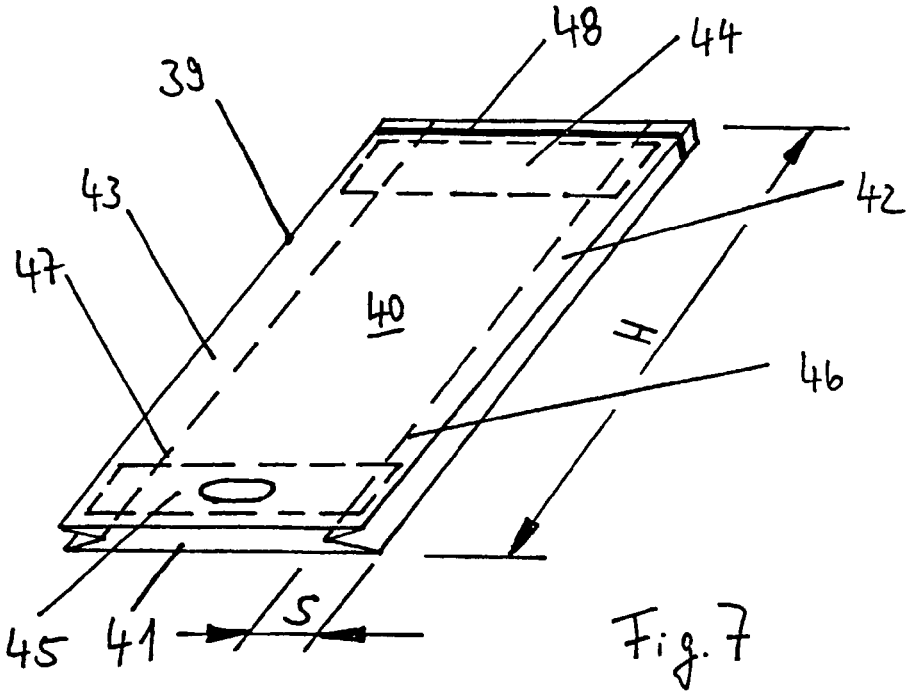
FIG. 7 is a three-dimensional view of a free-standing bag having a base seam.

The free-standing bags 39 can also be produced from two separate webs of plastic film 49, 50, and then to weld the two layers of film 49, 50, together prior to inserting the lateral folds 42, 43, so that a base seam 48 is created on the free-standing bag 39. A bag 39 such as this is illustrated in FIG. 7. Bag 39 is comprised of a front panel 40 and a back panel 41, whereby the lateral ends of the front panel 40 and the back panel 41 are folded in to form lateral folds 42, 43. In this exemplary embodiment, a separate assembly strip 44 and a reinforcing strip 45, respectively, is glued to the inside of front panel 40 and back panel 41.

If the free-standing bag 39 is unfolded, the assembly strip 45 is moved in the direction of the front panel and/or the back panel, and after unfolding, the lower areas of the front panel 40 and the back panel 41 form the base of the free-standing bag. The lateral folds 42, 43, are thereby also unfolded, resulting in the previously described square shape of the free-standing bag according to FIG. IV, whereby base 6 is formed of a base fold 6. The reinforcement strip 45 and the assembly strip 44 are thereby spaced apart from the lateral welding seams 46, 47, by width S, which is equal to the height of the lateral folds 42, 43. The front panel 40 and the back panel 41 of the free-standing bag 39 are connected at the base by a base seam 48.

Figure 8:
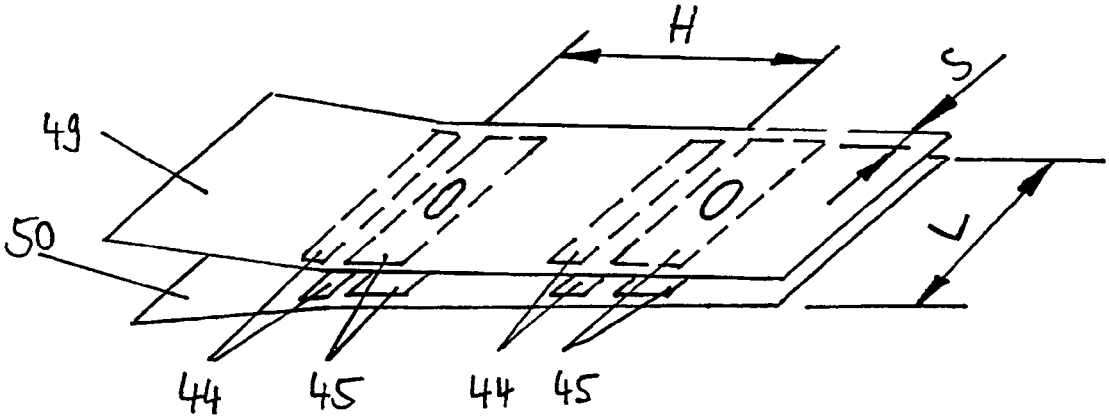
FIG. 8 is a basic illustration of a method for producing a free-standing bag having a base seam.

FIG. 8 is to illustrate the basic progression of the production of a free-standing bag 39 of FIG. 7. The free-standing bag 39 is produced from two separate webs of plastic film 49, 50. At appropriate interspaces H of the free-standing bags 39 to be produced, assembly strip 44 and reinforcing strip 45, respectively, are separately attached to webs of plastic film 49, 50. Preferably, strips 44, 45, are glued to the web of plastic film 49, 50. The lateral ends 46, 47, of the film webs 49, 50, are subsequently welded together [for forming—sic.]. After completion of the welding, a tube of film is at hand, to which the lateral folds 42, 43, are added in the next production step. The lateral folds 42, 43, are thereby folded over in accordance with distance S, whereby the assembly strips 44 and the reinforcement strip 45 are not folded in, but are arranged in their entirety on the front panel 40 and the back panel 41. In a final step, the base seam 48 is inserted in the tube of film, and simultaneously, a finished bag 39 is severed from the tube of film.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A free-standing bag made of a thermoplastic synthetic film, comprising:

a front panel;

a back panel;

lateral seams connecting the front panel with the back panel, thereby forming a filling opening, and in a collapsed state the bag has an inwardly folded base, the inwardly folded base including a frontpanel fold and a backpanel fold, the frontpanel fold and backpanel fold being welded into the lateral seams;

an assembly strip being attached to the frontpanel fold and to the backpanel fold, the assembly strip being formed of a more rigid plastic film than the plastic film of the bag, the assembly strip terminating at a first distance from the lateral seams; and a reinforcement strip being attached to the front panel and the back panel in an area of the filling opening on an interior and/or exterior side, the reinforcement strip terminating at a second distance from the lateral seams, wherein a value of the second distance of the reinforcement strip from each lateral seam is at least that of a height of the base fold in a collapsed state.

2. The free-standing bag according to claim 1, wherein, in the area of the filling opening, the front panel and the back panel are double-layered.

3. The free-standing bag according to claim 2, wherein the reinforcing strip is glued to the inner side of the double-layered area of the front panel and the back panel.

4. The free-standing bag according to claim 2, wherein, in the area of the filling opening, a handle is formed or welded on.

5. The free-standing bag according to claim 1, wherein the assembly strip is glued to an inner and/or outer side of the base.

6. The free-standing bag according to claim 1, wherein a value of the first distance of the assembly strip from each lateral seam is at least that of a height of the base fold in a collapsed state.

7. The free-standing bag according to claim 1, wherein a value of the first distance of the assembly strip from each lateral seam is at least that of a height of the base fold in a collapsed state.

8. The free-standing bag according to claim 1, wherein a width of the assembly strip is equal to a width of the reinforcing strip such that the free-standing bag forms a box-shaped free-standing bag when the free-standing bag is in an unfolded state.

9. The free-standing bag according to claim 1, wherein the front panel and the back panel have a grip hole in the area of the filling opening, and wherein the grip hole extends through the front panel, the back panel, and the reinforcement strip.

10. The free-standing bag according to claim 1, wherein said first distance and said second distance are greater than zero.

11. The free-standing bag according to claim 1, wherein said first distance is equal to said second distance.

12. A method for producing a free-standing bag according to claim 1, the method comprising:

conveying one or a plurality of horizontally spread-out webs of plastic film;

adding and attaching the assembly strip and the reinforcing strip;

folding the web of plastic film to form the front panel and the back panel;

inserting the base fold; and forming the lateral seams by welding the web of plastic film.

13. A free-standing bag made of a thermoplastic synthetic film, comprising:

a front panel;

a back panel;

lateral seams connecting the front panel with the back panel, thereby forming a filling opening, and in a collapsed state the bag has an inwardly folded base, the inwardly folded base including a frontpanel fold and a backpanel fold, the frontpanel fold and backpanel fold being welded into the lateral seams;

an assembly strip being attached to the frontpanel fold and to the backpanel fold, the assembly strip being formed of a more rigid plastic film than the plastic film of the bag, the assembly strip terminating at a first distance from the lateral seams; and a reinforcement strip being attached to the front panel and the back panel in an area of the filling opening on an interior and/or exterior side, the reinforcement strip terminating at a second distance from the lateral seams, wherein, in the area of the filling opening, the front panel and the back panel are double-layered;

wherein, a handle is connected to the double-layered area at least one connection location; and wherein the reinforcing strip is arranged above the welding for the handle inside the double-layered area between the at least one connection location and the filling opening.

14. The free standing bag according to claim 13, wherein a value of the second distance of the reinforcement strip from each lateral seam is at least that of a height of the base fold in a collapsed state.

15. The freestanding bag according to claim 13, wherein a width of the assembly strip is less than a width of the reinforcing strip such that a width of the free-standing bag in the area of the inwardly folded base is less than a width of the filling opening of the free-standing bag when the free-standing bag is in an unfolded state.

16. The free standing bag according to claim 15, wherein a value of the second distance of the reinforcement strip from each lateral seam is at least that of a height of the base fold in a collapsed state.

17. A free-standing bag made of a thermoplastic synthetic film, comprising:

a front panel;

a back panel;

lateral seams connecting the front panel with the back panel, thereby forming a filling opening, and in a collapsed state the bag has an inwardly folded base, the inwardly folded base including a frontpanel fold and a backpanel fold, the frontpanel fold and backpanel fold being welded into the lateral seams;

an assembly strip being attached to the frontpanel fold and to the backpanel fold, the assembly strip being formed of a more rigid plastic film than the plastic film of the bag, the assembly strip terminating at a first distance from the lateral seams; and a reinforcement strip being attached to the front panel and the back panel in an area of the filling opening on an interior and/or exterior side, the reinforcement strip terminating at a second distance from the lateral seams, wherein a width of the assembly strip is less than a width of the reinforcing strip such that a width of the free-standing bag in the area of the inwardly folded base is less than a width of the filling opening of the free-standing bag when the free-standing bag is in an unfolded state.

* * * * *